US007425143B2

(12) United States Patent
Mitsui

(10) Patent No.: US 7,425,143 B2
(45) Date of Patent: Sep. 16, 2008

(54) ROTARY CONNECTOR DEVICE

(75) Inventor: Takahiro Mitsui, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/647,168

(22) Filed: Dec. 29, 2006

(65) Prior Publication Data

US 2007/0184693 A1 Aug. 9, 2007

(30) Foreign Application Priority Data

Feb. 9, 2006 (JP) ..... 2006-032256

(51) Int. Cl.
*H01R 3/00* (2006.01)

(52) U.S. Cl. ..... 439/164; 439/15; 242/388

(58) Field of Classification Search ..... 439/164, 439/15; 242/388, 388.5
See application file for complete search history.

(56) References Cited

U.S. PATENT DOCUMENTS 5,046,951 A * 9/1991 Suzuki ..... 439/15
5,841,069 A * 11/1998 Nagaoka et al. ..... 174/69
6,012,935 A * 1/2000 Bolen et al. ..... 439/164
6,494,396 B2 * 12/2002 Sugata ..... 242/388.5

FOREIGN PATENT DOCUMENTS

JP 64-050711 A 2/1989
JP 1-148688 U 10/1989
JP 10-64646 A 3/1998
JP 2001-28286 A 1/2001

* cited by examiner

*Primary Examiner*—Truc T Nguyen
(74) *Attorney, Agent, or Firm*—Sughrue Mion, PLLC

(57) ABSTRACT

A rotary connector device includes one cover having an outer peripheral wall, the other cover having an inner peripheral wall, and a plurality of flat harnesses which are received in a generally annular shape within a space formed by the two covers, and are rotated and bent in accordance with a rotational motion of one of the two covers. There are provided a plurality of guide portions for guiding the plurality of flat harnesses along the outer peripheral wall and/or the inner peripheral wall independently of each other. The plurality of guide portions are spaced from each other in a harness longitudinal direction. The plurality of guide portions are formed respectively at wall portions, extending respectively in contiguous relation to the outer peripheral wall and the inner peripheral wall in peripheral directions thereof, and regions spaced respectively from the wall portions in directions of extending of the wall portions.

2 Claims, 4 Drawing Sheets

ROTARY CONNECTOR DEVICE

BACKGROUND OF THE INVENTION

1. Field of the Invention

This invention relates to a rotary connector device which is provided, for example, around a steering of an automobile so as to effect a power supply, etc., while absorbing the rotation of the steering by bending and rotating flat harnesses.

2. Related Art

FIG. 4 shows one conventional rotary connector device (see JP-A-10-64646 Publication).

This rotary connector device 61 is provided in the vicinity of a steering (steering wheel) 62, and comprises an annular rotary cover 64 fixed to a steering shaft 63, an annular fixed cover 65 which is disposed around the outer periphery of the steering shaft 63, and is fixed to a combination switch 69, and a flexible flat harness 67 which is disposed in a generally spirally-wound condition within an annular (doughnut-shaped) space 66 formed by the two covers 64 and 65.

Rollers 68 are rotatably provided within the annular space 66, and the flat harness 67 is circumferentially disposed in contiguous relation to an inner peripheral wall of the rotary cover 64 at the inner side of the rollers 68, and is also circumferentially disposed in contiguous relation to an outer peripheral wall of the fixed cover 65 at the outer side of the rollers 68. One end of the flat harness 67 is connected at the rotary cover-side to an air bag device, a horn, etc., provided within the steering wheel, while the other end of the flat harness 67 is connected at the fixed cover-side to a power source, etc.

FIG. 5 shows an internal structure of a fixed cover of another conventional rotary connector device (see JP-A-2001-28286 Publication).

The fixed cover 70 includes a disk-like wall portion 72 having a hole 71 formed through a central portion thereof, and an annular outer peripheral wall 73 formed at an outer peripheral edge of the disk-like wall portion 72. This fixed cover 70 has a harness guide wall 74 extending in contiguous relation to an inner surface of the outer peripheral wall 73 in a peripheral direction thereof. A flexible flat harness 75 is introduced from the exterior into the inside of the fixed cover 70 through a gap between the guide wall 74 and the outer peripheral wall 73. The flat harness 75 comprises a plurality of parallel conductor portions 75*a*, and a sheet-like insulating portion 75*b* covering these conductor portions 75*a*.

However, with respect to the conventional rotary connector device having the fixed cover 70 shown in FIG. 5, in the case where with an increased number of connection circuits, two flat harnesses 75 are used in a superposed manner as indicated by broken lines, the two flat harnesses 76 are pulled in accordance with the rotation of a rotary cover, and contact a distal end 74*a* of the guide wall 74. In this case, particularly when this contact pressure is excessive, there has been a fear that the two flat harnesses 75 are broken or cut, so that the short-circuiting between the two flat harnesses 75 occurs, thereby causing wrong operations of associated electrical equipments, etc.

SUMMARY OF THE INVENTION

With the foregoing in view, it is an object of this invention to provide a rotary connector device in which even when a plurality of flat harnesses are installed or arranged in a superposed manner, the short-circuiting between the flat harnesses can be positively prevented upon breakage of the flat harnesses due to their interference with respective guide walls.

The above object has been achieved by a rotary connector device according to one aspect of the invention including a first cover having an outer peripheral wall, a second cover having an inner peripheral wall, and a plurality of flat harnesses which are received in a generally annular shape within a space formed by the first and second covers, and are rotated and bent in accordance with a rotational motion of one of the two covers; wherein a plurality of guide portions are provided for guiding the plurality of flat harnesses along the outer peripheral wall and/or the inner peripheral wall independently of each other.

With this construction, the flat harnesses are introduced into the space (formed by the first and second covers) separately from each other. In accordance with a relative rotation between the two covers, the flat harnesses, while rotating, are reversed (or turned back) and bent within the space. Even if the flat harnesses should be damaged or broken when the flat harnesses are pulled by an excessive pulling force to abut hard against distal ends of the respective guide portions or if the flat harnesses should be worn as a result of interference with the guide portions, the damaged portions of the flat harnesses are spaced from each other, and therefore there is no risk of short-circuiting between the flat harnesses. The number of the guide portions may be equal to or larger than the number of the flat harnesses. With respect to the arrangement of the guide portions, the mating guide portions may be juxtaposed in the longitudinal direction of the flat harnesses (These guide portions may be disposed relatively close to each other or may be spaced a relatively long distance from each other), or may be juxtaposed in a widthwise direction of the flat harnesses.

The rotary connector device according to one aspect of the invention is characterized in that the plurality of guide portions are spaced from each other in a harness longitudinal direction.

With this construction, the flat harnesses, superposed together, are installed along the outer peripheral wall and the inner peripheral wall, and are passed along the respective guide portions, and are guided by these guide portions. For example, the flat harnesses are installed between an inner surface of the outer peripheral wall and an outer surface of the first (rear) guide portion, and the first (inner) flat harness is introduced into the inside of the covers via the first (rear) guide portion, and the other flat harness is installed between the inner surface of the outer peripheral wall and an outer surface of the second (front) guide portion, and is introduced into the inside of the covers via the second guide portion.

The rotary connector device according to one aspect of the invention is characterized in that the plurality of guide portions are formed respectively at wall portions, extending respectively in contiguous relation to the outer peripheral wall and the inner peripheral wall in peripheral directions thereof, and regions spaced respectively from the wall portions in directions of extending of the wall portions.

With this construction, for example, the flat harnesses pass through a gap between the outer peripheral wall and the wall portion disposed in contiguous relation thereto, and the first (inner) flat harness is introduced into the inside of the covers via the first (rear) guide portion (formed integrally with the wall portion) of the wall portion, and the second (outer) flat harness is introduced into the inside of the covers via the second (front) guide portion spaced from the wall portion in the direction of extending of the wall portion.

According to one aspect of the invention, even if the flat harnesses should be damaged when the flat harnesses are pulled by an excessive pulling force to abut hard against distal ends of the respective guide portions or if the flat harnesses should be worn as a result of interference with the guide portions, the damaged portions of the flat harnesses are spaced from each other, and therefore there is no risk of short-circuiting between the flat harnesses, and wrong operations of associated electrical equipments, auxiliary equipments, etc., due to the short-circuiting are prevented.

According to one aspect of the invention, the flat harnesses are installed in such a manner that they are superposed together in the direction of the thickness thereof, and the flat harnesses are guided along the respective guide portions, and are separated from each other by the guide portions. With this construction, even when the plurality of guide portions are provided, the space formed by the covers will not increase, so that the structure can be formed into a simplified and space-saving design.

According to one aspect of the invention, the guide portions are formed integrally with the respective wall portions disposed respectively in contiguous relation to the outer peripheral wall and the inner peripheral wall, and the other guide portions are formed respectively at the regions spaced from the wall portions in the direction of extending of the wall portions. With this arrangement, the flat harnesses, superposed together, are installed along the wall portions, and can be smoothly introduced one by one into the inside of the covers via the respective guide portions without a bending action, etc., thereby ensuring the durability of the flat harnesses and the reliability of the power supply.

DETAILED DESCRIPTION OF THE PREFERRED EMBODIMENTS

Figure 1:
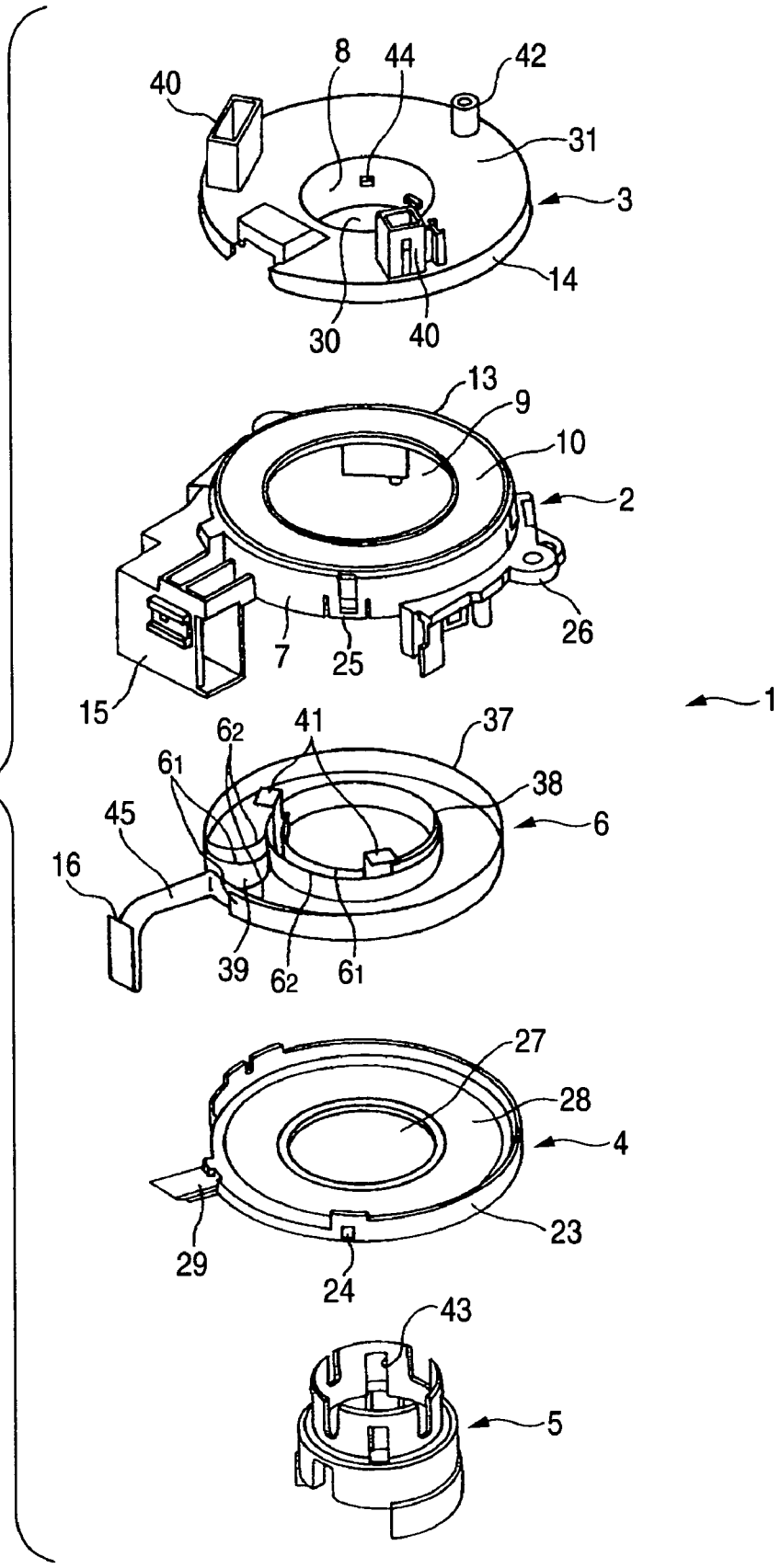
FIG. 1 is an exploded, perspective view showing one preferred embodiment of a rotary connector device of the present invention.
Figure 2:
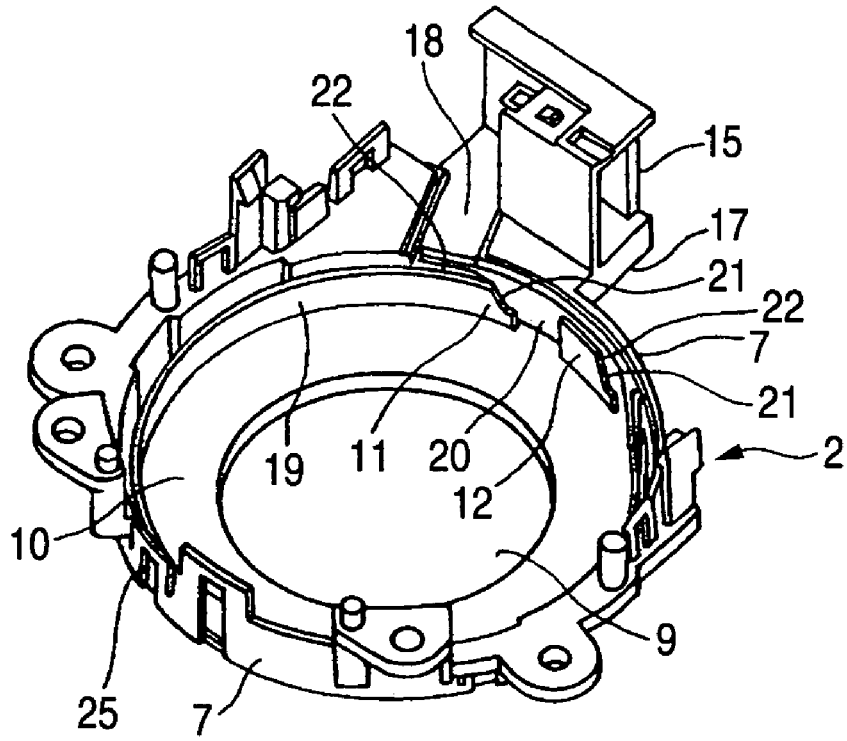
FIG. 2 is an exploded, perspective view of a fixed cover and a rotary cover of the rotary connector device as seen from the reverse side.
Figure 2:
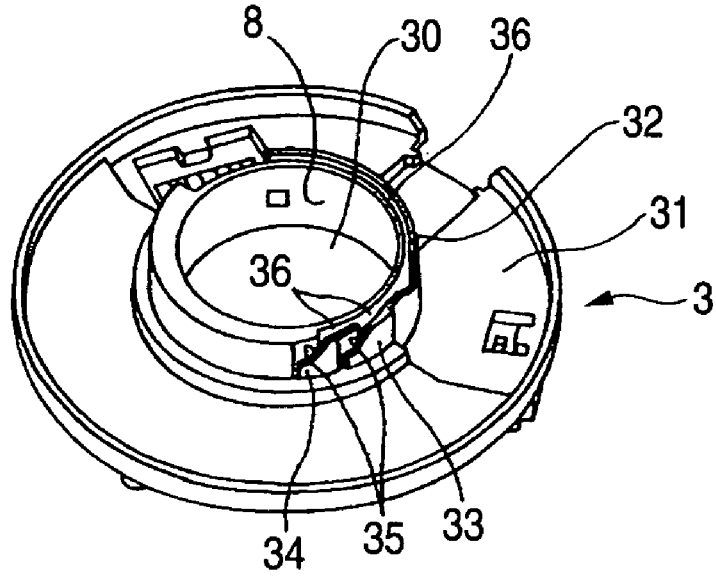
Figure 3:
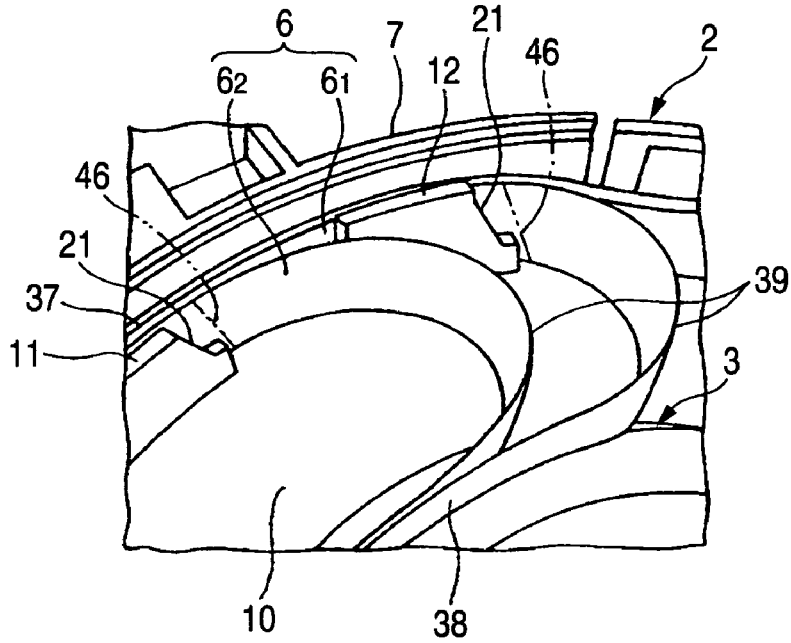
FIG. 3 is a perspective view of an important portion of the rotary connector device, showing a condition in which flat harnesses are installed in the rotary connector device.
Figure 4:
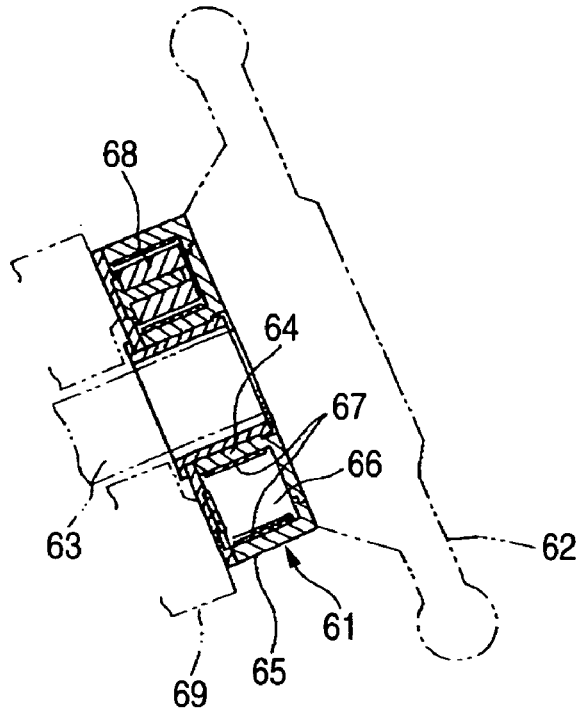
FIG. 4 is a vertical cross-sectional view of one conventional rotary connector device.
Figure 5:
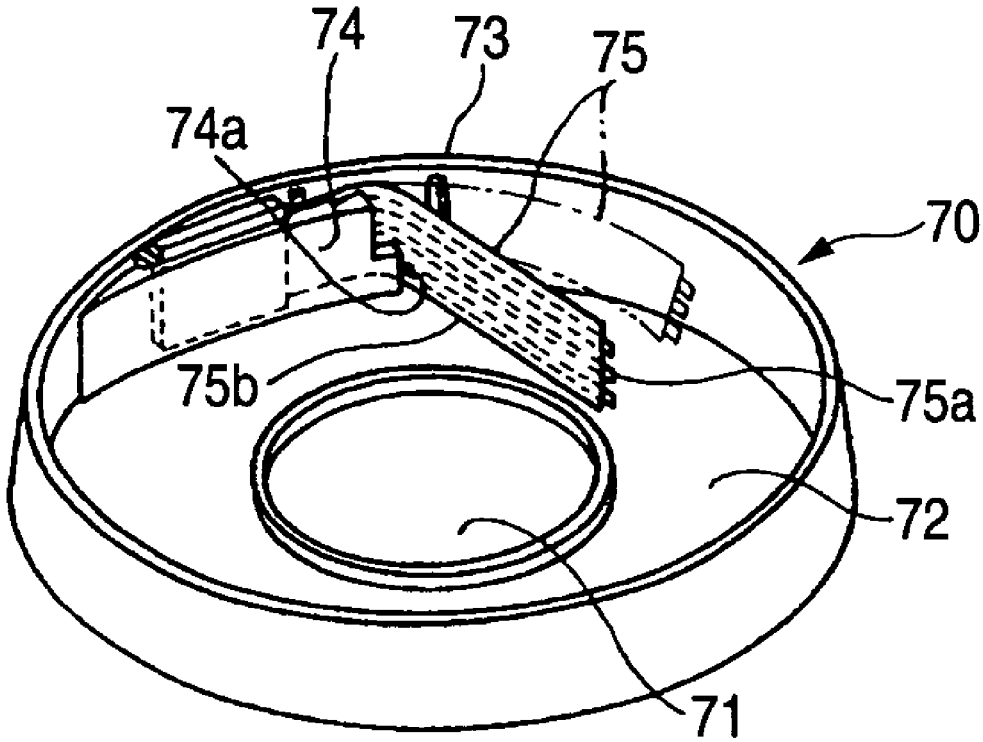
FIG. 5 is a perspective view showing an internal structure of another conventional rotary connector device.

FIGS. 1 to 3 show one preferred embodiment of a rotary connector device of the present invention.

As shown in FIG. 1 (which is a view as seen from the front side), this rotary connector device 1 comprises a fixed cover (first cover) 2, a rotary cover (second cover) 3, a fixed lid 4, a rotary tube 5, and two flexible flat harnesses 6 which are superposed together, and are received in a generally spirally-wound condition in an annular space formed by the fixed cover 2, the rotary cover 3 and the fixed lid 4. Each of the fixed cover 2, the rotary cover 3, the fixed lid 4 and the rotary tube 5 is made of a synthetic resin. The rotary connector device 1 has a feature that there are provided two guide walls 11 and 12 which cause the two flat harnesses 6 ($\mathbf{6}_1$ and $\mathbf{6}_2$) to independently (or separately) pass respectively to the outer peripheral wall (7)-side of the fixed cover 2 and the inner peripheral wall (8)-side of the rotary cover 3, the two guide walls 11 and 12 being spaced from each other in a harness longitudinal direction, as shown in FIGS. 2 and 3 (which are views as seen from the reverse side).

As shown in FIGS. 1 and 2, the fixed cover 2 includes a disk-like wall portion 10 having a central hole 9, and the outer peripheral wall 7 integrally formed integrally at an outer peripheral edge of the disk-like wall portion 10 and projecting perpendicularly therefrom. An annular rib 13 (FIG. 1) is formed on the disk-like wall portion 10, and is disposed near to the outer periphery thereof, and an inner surface of a distal end portion of an outer peripheral wall 14 of the rotary cover 3 is rotatably engaged with the rib 13.

A connector housing 15 is formed integrally on the outer peripheral wall 7 of the fixed cover 2, and a plurality of male terminals (not shown) are provided within the connector housing 15, and proximal ends of the male terminals are connected to one end portions 16 (which are outer peripheral portions) of the flat harnesses 16 via a small circuit board (not shown). The connector housing 15 and the terminals jointly form a connector. Instead of the male terminals, female terminals or any other suitable terminals can be used.

As shown in FIG. 2, a recessed groove 18 is formed in a reverse surface of a horizontal support wall 17 of the fixed cover 2 extending from the connector housing 15. The fixed cover 2 has an annular wall portion 19 which circumferentially extends in contiguous relation to the inner surface of the outer peripheral wall 7 in a manner to assume a double wall construction. Part of the annular wall portion 19 is removed or notched to form a notch 20, so that the harness guide portions (guide walls) 11 and 12 are formed respectively at the front and rear sides of the notch 20, and are juxtaposed to each other in the harness longitudinal direction.

The rear (first) guide portion 11 is a distal end portion of the annular wall portion 19, and the front (second) guide portion 12 is a short guide wall which is separated or spaced apart from the annular wall portion 19 by the notch 20, and is curved with the same radius of curvature as that of the annular wall portion 19. A distal end 21 of each of the guide walls 11 and 12 has a slanting surface. The term "front side" means the forward side in the harness passing direction.

A gap 22 for the passage of the flat harness(es) 6 is formed between the outer peripheral wall 7 and each of the guide walls 11 and 12. The gap 22 at the rear guide wall 11 is continuous with the recessed groove 18 of the support wall 17. Outer peripheral portions (outer portions) 37 of the two flat harnesses 6 (FIG. 1) are passed through the gap 2 at the rear guide wall 11, and one (outer) flat harness $\mathbf{6}_1$ passed through the gap 22 at the front guide wall 12. The flat harnesses 6 are introduced one by one respectively via the respective guide walls 11 and 12 into the space formed by the covers 2 and 3.

Retaining frame-like portions 25 for retaining engagement with a low-height outer peripheral wall 23 and retaining projections 24 of the fixed lid 4 (FIG. 1), as well as brackets 26 for being fixed by screws to a combination switch and so on (fixed structural members) disposed exteriorly of a steering shaft (not shown) of an automobile, are formed at the outer peripheral wall 7 of the fixed cover 2. A plate portion 29 for closing the recessed groove 18 (FIG. 2) is formed on and extends from an outer peripheral edge of a disk-like wall portion 28 of the fixed lid 4, the disk-like wall portion 28 having a central hole 27.

The rotary cover 3 includes a disk-like wall portion 31 having a central hole 30, the outer peripheral wall 14 of a low height formed at an outer peripheral edge of the disk-like wall portion 31 and projecting perpendicularly therefrom, and the inner peripheral wall 8 formed at and projecting long perpendicularly from an inner peripheral edge of the hole 30 into a tubular shape. The rotary cover 3 further includes a semi-annular wall portion 32 (FIG. 2) circumferentially extending in contiguous relation to the outer peripheral surface of the inner peripheral wall 8, and two harness guide portions (guide walls) 33 and 34 which are formed adjacent to the semi-annular wall portion 32, and are juxtaposed to each other in the forward-rearward direction (the harness longitudinal direction).

The rear (first) guide wall 33 is formed integrally with the semi-annular wall portion 32, and the front (second) guide wall 34 is separated or spaced from the semi-annular wall portion 32. The two guide walls 33 and 34 are disposed in proximity to each other (that is, partially overlaps each other) in the harness longitudinal direction. The direction of introduction of the harnesses into the inside of the covers via the guide walls 11 and 12 of the fixed cover 2 is the same as the direction of introduction of the harnesses into the inside of the covers via the guide walls 33 and 34 of the rotary cover 3. Each of the guide walls 33 and 34 has a slanting surface formed at its distal end 35.

A gap 36 for the passage of the two flat harnesses 6 therethrough is formed between the inner peripheral wall 8 and semi-annular wall portion 32 (FIG. 2) of the rotary cover 3. Inner peripheral portions (inner portions) 38 of the two flat harnesses 6 (FIG. 1) are passed through the gap 36 between the rear guide wall 33 and the inner peripheral wall 8, and one (outer) flat harness $\mathbf{6}_2$ is introduced into the inside of the covers via the rear guide wall 33, and one (inner) flat harness $\mathbf{6}_1$ is passed through the gap 36 between the front guide wall 34 and the inner peripheral wall 8, and is introduced into the inside of the covers via the front guide wall 34. The flat harnesses 6 are reversed with respect to their inner and outer surfaces by their respective turned-back portions 39 lying between the inner peripheral portions 38 and outer peripheral portions 37.

Connector housings 40 (FIG. 1) are formed integrally on the disk-like wall portion 31 of the rotary cover 3, and a plurality of male terminals (not shown) are provided within each connector housing 40, and the male terminals of the connector housings 40 are connected to the other end portions 41 of the respective flat harnesses 6 via respective circuit boards (not shown). Each circuit board is covered with a small sub-cover (not shown), and is disposed between the disk-like wall portion 31 of the rotary cover 3 and this sub-cover, and thus is protected for insulating purposes. The connector housing 40 and the terminals jointly form a connector. Instead of the male terminals, female terminals or any other suitable terminals can be used.

A connecting pin 42 for a steering wheel (rotary member) of the automobile is formed on the disk-like wall portion 31 of the rotary cover 3. Retaining projections 44 for engagement with respective retaining frame-like portions 43 of the rotary tube 5 (FIG. 1) are formed on the inner peripheral surface of the inner peripheral wall 8 of the rotary cover 3. The rotary tube 5 is also called a turn canceller, and is provided around the outer periphery of the steering wheel, and rotates together with the rotary cover 3. In a mounted or assembled condition of the rotary connector device, the rotary cover 3 is disposed at the upper side, while the fixed cover 2 is disposed at the lower side.

The two flat harnesses 6 (FIG. 1) include the respective portions (connecting portions) 16 which are to be connected to the terminals within the connector housing 15, respective straight portions 45 extending from the respective connecting portions 16 along the recessed groove 18 (FIG. 2) of the fixed cover 2, the respective outer peripheral portions (outer portions) 37 extending counterclockwise (in FIG. 1) from the respective straight portions 45 to make a circle with a large diameter, the respective inner peripheral portions (inner portions) 38 which are turned back (The turned-back portions are designated by reference numeral 39) from the respective outer peripheral portions 37, and extend clockwise to make a circle of a small diameter, the respective portions (connecting portions) 41 (which are to be connected to the terminals within the connector housings 40 of the rotary cover 3) extending in an upstanding manner from the respective inner peripheral portions 38. Thus, the two flat harnesses 6 are formed into a generally annular shape or a generally spirally-wound shape.

The outer peripheral portions 37 of the two flat harnesses 6 are installed respectively along the guide walls 11 and 12 (FIG. 2) of the fixed cover 2 independently of each other, and the inner peripheral portions 38 of the two flat harnesses 6 are installed respectively along the guide walls 33 and 34 (FIG. 2) of the rotary cover 3 independently of each other. FIG. 3 shows a condition in which the two flat harnesses 6 are introduced respectively via the guide walls 11 and 12 of the fixed cover 2, and are turned back (The turned-back portions are designated by reference numeral 39), and then are installed respectively along the guide walls 33 and 34 (FIG. 2) of the rotary cover 3.

Preferably, a plurality of idler rollers (not shown) are provided between the outer peripheral portions 37 (FIG. 1) and inner peripheral portions 38 of the flat harnesses 6 (although this is not essential). The idler rollers are supported by an annular carrier (not shown) having a support shaft.

The rotary cover 3 is rotated in accordance with the rotation of the steering wheel (not shown), and the inner peripheral portions 38 of the flat harnesses 6 are rotated together with the rotary cover 3. When the inner peripheral portions 38 of the flat harnesses 6 are rotated in a clockwise direction (in FIG. 1), the turned-back portions 39 are rotated together with the outer peripheral portions 37 in the same direction by an amount generally half of the amount of rotation of the inner peripheral portions 38, and also when the inner peripheral portions 38 are rotated in a counterclockwise direction, the turned-back portions 39 are rotated together with the outer peripheral portions 37 in the same direction by an amount generally half of the amount of rotation of the inner peripheral portions 38, thereby absorbing the rotation of the steering wheel.

If the flat harnesses 6 should be pulled hard in the reverse direction by a large force, with their bent portions abutting respectively against the guide walls 11 and 12 or if the flat harnesses 6 should be worn by interference with the distal ends 21 of the guide walls 11 and 12 because of repeated bending actions, etc., the two flat harnesses 6 are damaged or broken at their respective portions (as indicated by broken lines 46) spaced from each other in the harness longitudinal direction. Therefore, the short-circuiting between the two flat harnesses will not occur, and wrong operations of associated electrical equipments, auxiliary equipments, etc., are prevented. Similar effects can also be achieved by the guide walls 33 and 34 of the rotary cover 3.

In the above embodiment, although the two flat harnesses 6 are used, three or more flat harnesses 6 can be used, in which case guide walls equal in number to the flat harnesses 6 are arranged in a juxtaposed, spaced manner in the harness longitudinal direction, and with this arrangement similar effects as described above can be achieved. Furthermore, in the case where there are provided guide walls larger in number than the flat harnesses 6, the rotary connector device can be used as a common device when the number of circuits increases according to the grade of the vehicle.

Furthermore, in the above embodiment, although the guide portions 11 and 12 are formed in a space-apart manner on the fixed cover 2, while the guide portions 33 and 34 are formed in a spaced-apart manner on the rotary cover 3, these guide portions can be suitably formed in a spaced-apart manner only on the fixed cover 2 or the rotary cover 3.

Furthermore, in the above embodiment, the rotary connector device 1 is provided around the steering of the automobile, the rotary connector device 1 can be applied to other rotary portion than the steering so as to effect a power supply to the rotary portion, etc., while absorbing the rotation of the rotary portion.

Furthermore, in the above embodiment, the outer peripheral wall 7 is formed at the fixed cover 2, and the inner peripheral wall 8 is formed at the rotary cover 3. However, for example, there can be adopted a construction in which the inner peripheral wall 8 is formed at the fixed cover 2, and the outer peripheral wall 7 is formed at the rotary cover 3, and the fixed cover 2 is rotatable while the rotary cover 3 is fixed. This construction is possible since a relative rotation is made between the two covers 2 and 3.

Furthermore, in the above embodiments, the guide portions 11 and 12, as well as the guide portions 33 and 34, are spaced from each other in the harness longitudinal direction. However, in the case where the depth of the cover 2 can be so increased that the flat harnesses 6 can be arranged or installed parallel to each other in the direction of the width of the flat harnesses 6 (transverse direction), the guide portions 11 and 12, as well as the guide portions 33 and 34, can be spaced from each other not in the harness longitudinal direction but in the harness widthwise direction.

What is claimed is:

1. A rotary connector device comprising:

a first cover having an outer peripheral wall;

a second cover having an inner peripheral wall; and a plurality of flat harnesses which are received in a generally annular shape within a space formed by said two covers, and are rotated and bent in accordance with a rotational motion of one of said first and second covers;

wherein a plurality of guide portions are provided for guiding said plurality of flat harnesses along at least one of said outer peripheral wall and said inner peripheral wall independently of each other;

said plurality of guide portions includes two guide portions which guide two of the plurality of flat harnesses that are disposed in a same direction along different directions independently of each other;

wherein a space is formed between said plurality of guide portions in a harness longitudinal direction; and wherein one of said plurality of harnesses turns back by passing through the space, and another of the plurality of harnesses turns back by extending beyond the space and passing around a distal end of one of the guide portions; wherein the space and the distal end of one of the guide portions are provided adjacent to one another at a same side of the device.

2. A rotary connector device according to claim 1, wherein said guide portions are formed respectively at wall portions, extending respectively in contiguous relation to said outer peripheral wall and said inner peripheral wall in peripheral directions thereof, and regions spaced respectively from said wall portions in directions of extending of said wall portions in directions of extending of said wall portions.

* * * * *